United States Patent [19]

Gressler et al.

[11] Patent Number: 4,639,185

[45] Date of Patent: Jan. 27, 1987

[54] BAG PACKAGE TRANSFER APPARATUS

[75] Inventors: Walter Gressler, Bergisch-Gladbach; Karl Kern, Schwalmtal-Amern, both of Fed. Rep. of Germany

[73] Assignee: Robert Bosch GmbH, Stuttgart, Fed. Rep. of Germany

[21] Appl. No.: 788,363

[22] Filed: Oct. 17, 1985

[30] Foreign Application Priority Data

Jan. 21, 1985 [DE] Fed. Rep. of Germany ..... 3501771

[51] Int. Cl.[4] ..... B25J 3/00

[52] U.S. Cl. ..... 414/733; 53/393; 414/710; 901/29

[58] Field of Search ..... 53/393; 414/706, 707, 414/710, 917; 901/29

[56] References Cited

U.S. PATENT DOCUMENTS

| | | | |
|---|---|---|---|
| 4,140,226 | 2/1979 | Richter | 414/917 |
| 4,329,110 | 5/1982 | Schmid | 414/917 |
| 4,329,111 | 5/1982 | Schmid | 414/917 |
| 4,441,852 | 4/1984 | Dixon | 414/917 |

*Primary Examiner*—John Sipos
*Assistant Examiner*—Donald R. Studebaker
*Attorney, Agent, or Firm*—Edwin E. Greigg

[57] ABSTRACT

A transfer apparatus for bag packages in a packaging machine has a pair of tongs with jaws for transferring a flat bag which is delivered in a vertical plane, to bag holders of a conveyor apparatus on a path extending transversely to the plane (I) in which the bags are delivered. For quiet operation, which also needs little readjustment or supervision, the jaws are actuated via connecting rods and a lever mechanism. The tongs are rotatably supported on a pivot arm which is pivotable coaxially with the axis of rotation of the crank of the lever mechanism.

3 Claims, 3 Drawing Figures

BAG PACKAGE TRANSFER APPARATUS

BACKGROUND OF THE INVENTION

The invention relates to a transfer apparatus for bag packages as generally defined hereinafter. In a known packaging machine of the present applicant, the jaws of the tongs are each provided with a gear wheel and are rotated via two endless chains, which furthermore are guided about driving gear wheels disposed coaxially with the pivot shaft of the pivot arm. One of the driving gear wheels is mounted on a shaft which is supported in a hollow shaft bearing the other gear wheel. This hollow shaft is supported in turn on a second hollow shaft, on which the pivot arm is affixed. The three shafts are controlled separately from one another by cam drives so as to pivot, open and close the tongs. The known transfer apparatus is expensive, because of its many separately controlled parts. Furthermore, the chain drives must be re-adjusted from time to time to assure reliable transferring of the bag packages.

OBJECT AND SUMMARY OF THE INVENTION

The bag package transfer apparatus according to the invention has the advantage that its structural parts are few and simple, and it also has little play. Further advantages are its low noise level in operation and the fact that it need not be supervised continuously.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
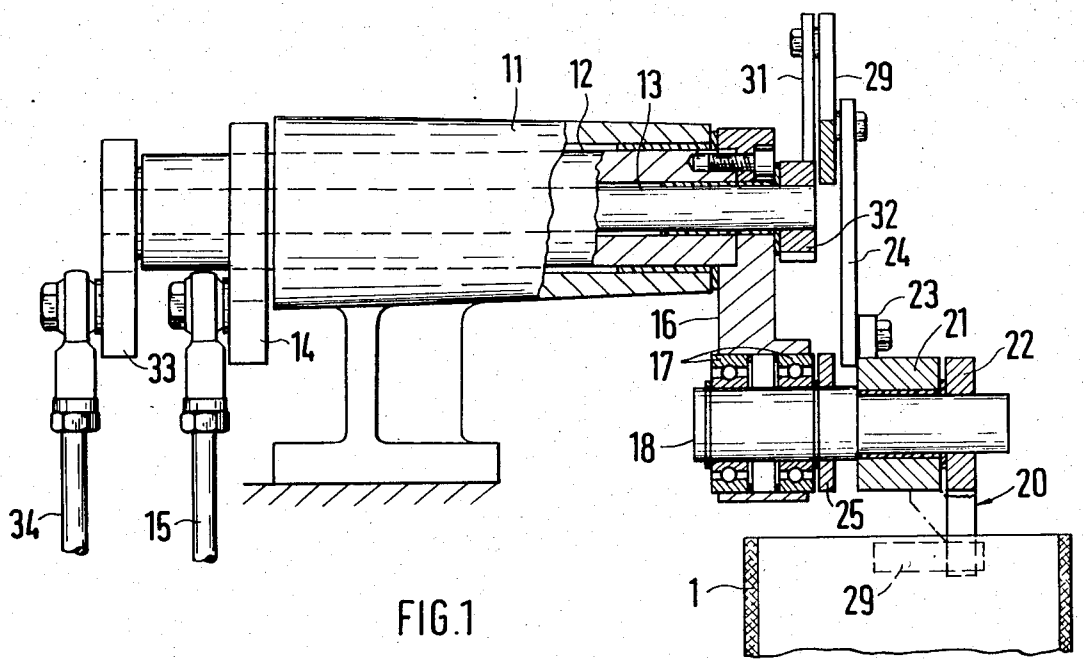
FIG. 1 is a front view of a transfer apparatus for bag packages, which is seen partially in section.
Figure 2:
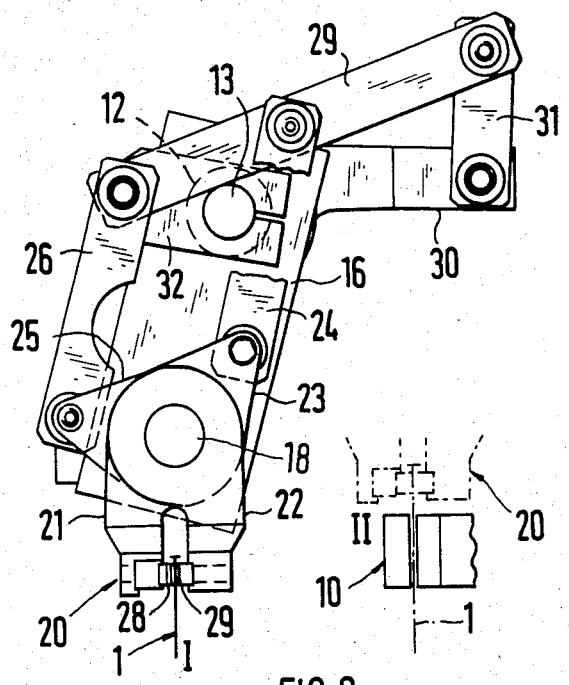
FIG. 2 is a side view of the transfer apparatus for bag packages shown in FIG. 1.
Figure 3:
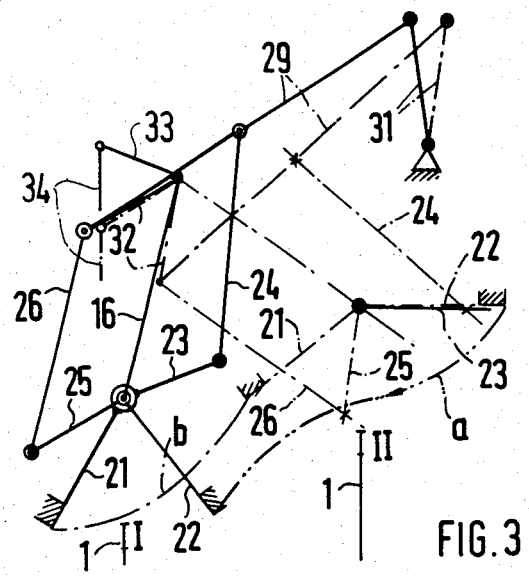
FIG. 3 is a schematic front view of the transfer apparatus for bag packages of FIG. 1 in two different operating positions.

For a better understanding of this invention reference is initially made to FIGS. 2 and 3. There it is seen that the transfer apparatus for bag packages is disposed in the end area of an apparatus for producing flat bag packages and serves to transfer one flat bag package 1 at a time from a vertical plane I, in which the package 1 has been delivered, to a plane II that is at right angles to the first by moving transversely into the grasping range of bag holders 10 on a bag package conveyor device of a packaging machine. The transfer apparatus has a bearing block 11, in which a hollow shaft 12 is rotatably supported, a further shaft 13 being rotatably supported in the shaft 12. On its left end, the hollow shaft 12 has a lever 14 articulated on a control link 15, and on its right end, the shaft 12 has a pivot arm 16 that extends downwardly. On the side of the pivot arm 16 remote from the bearing block 11, a shaft 18 which is rotatably supported in the pivot arm 16 by means of a ball bearing 17 is arranged to project outwardly.

On its outwardly projecting part, the shaft 18 has a pair of tongs 20, one jaw 21 of which is rotatable and the other jaw 22 of which is disposed fixedly on the shaft 18. The rotatable jaw 21 has a bent arm 23, on which a connecting rod 24 is articulated. Between the jaw 21 and the pivot arm 16, a lever 25 is also secured on the shaft 18 and is oriented at approximately right angles to the other jaw 22. Additionally, a connecting rod 26 is articulated on this lever 25. When the tongs 20 are closed, that is, when the two jaws 21, 22 are pressed together so that they grip a flat bag 1 with their two clamping bars 28, 28', the two connecting rods 24 and 26 are aligned parallel to one another and parallel to and on both sides of the longitudinal axis of the pivot arm 16. With their other ends, they are articulated onto a lever 29, one end of which is articulatedly joined to a guide rod 31 that is rotatably supported by an arm 30 offstanding from the bearing block 11. On the other end of the lever 29, on which the connecting rod 26 is articulated, a crank 32 is coaxially and articulatedly connected, being mounted firmly on one end of the shaft 13. A lever 33 which is engaged by a control link 34 is secured to the other end of the shaft 13.

The transfer apparatus for bag packages operates as follows:

By actuating the control link 15 by a cam drive, not shown, the tongs 20 are pivoted out of the plane I of a bag receiving station into a plane II of a bag transfer station and back again. In order to open and close the tongs 20 so as to grip or release a flat bag 1, the jaws 21, 22 of the tongs are pivoted by a cam drive, also not shown, by the actuation of the control link 34. Once the tongs 20 have gripped the upper portion of a flat bag 1 (see FIG. 2) by the pivoting together of their two jaws 21, 22, the pivoting arm 16 is pivoted toward the right for a predetermined distance, transversely to the plane in which the flat bag 1 is delivered and to the plane in which the tongs 20 grasp it, so that the tongs may reach the receiving station of the bag holders 10 of a conveyor apparatus. Because of the parallel orientation of the two connecting rods 24, 26 with respect to the pivot arm 16, the tongs 20 maintain their vertical alignment during their pivoting movement with their clamping bars 28, 28', thus the transferred flat bag 1 is aligned in the vertical plane in the bag receiving station as well.

Once the bag holders 10 have grasped the proffered flat bag 1, this bag 1 is released by the tongs 20. To this end, the crank 32 is pivoted downward a predetermined distance by the link 34 (FIG. 3, position indicated by dot-dash lines). The jaw 22 located at the front during the transfer movement of the flat bag 1 is pivoted upward by an angle of approximately 90° from the flat bag 1 via the connecting rod 26 and the lever 25, and the other, trailing jaw 21 is pivoted upward via the connecting rod 24 and the bent arm 23 by an angle of approximately 45°, which is reduced by the lever 29 and the guide rod 31. This opening width of the two jaws 21, 22 of the tongs 20 is sufficient so that when the tongs pivot back, one jaw 22 can move above the upper edge of the flat bag 1 in the transfer station along a path a, and the other jaw 21 can move above the upper edge of a new flat bag 1, which has just been delivered to the transfer station I, along a path b. Once the pivot arm 16 has pivoted back into the transfer station I, the two jaws 21, 22 are first partially closed (FIG. 3, position shown in solid lines) and are not closed completely, by the pivoting of the crank 32, until completion of the delivery of the new flat bag 1 so that it is ready for grasping.

It is also noted that in a packaging machine in which two flat bags at a time are handled at one station, the tongs 20 can also be embodied as double tongs for transferring two flat bags at a time.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. In a packaging machine the combination comprising a bag transfer apparatus for transferring bags in a vertical orientation, said apparatus having a pivot arm, a pair of tongs hinged to the pivot arm and including jaw means for grasping a flat bag at a first station, first lever means for pivoting said pivot arm to traverse said bag through a fixed path by a swinging movement of the pivot arm so as to position said flat bag onto a conveyor apparatus at a second station, a second lever means being linked to parallel spaced-apart connecting rod means by crank means, said connecting rod means being aligned substantially symmetrically adjacent to said pivot arm said crank means being linked to a first end of said connecting rod means by a coupling element and said tongs are articulated by a second end of said connecting rod means, said connecting rod means maintaining said bags in said vertical orientation during pivoting of said pivot arm and operable by said second lever means to open and close said tongs at said first and second stations, said first and second lever means are connected to individual and separate drive means.

2. An apparatus as defined by claim 1, further wherein said coupling element includes oppositely extending end portions, one of said end portions being connected to said crank means and to a first connecting rod and another of said end portions being connected to a guide rod, and a second connecting rod articulated medially of said coupling element.

3. An apparatus as defined by claim 1 in which said individual drive means are coaxially driven shafts.

* * * * *